US007613410B2

(12) United States Patent
Doi et al.

(10) Patent No.: US 7,613,410 B2
(45) Date of Patent: Nov. 3, 2009

(54) IMAGE FORMATION APPARATUS AND HEAT ROLLER ADJUSTMENT SUPPORT METHOD

(75) Inventors: Yohei Doi, Shizuoka-ken (JP); Hiroshi Nakayama, Shizuoka-ken (JP); Tetsuo Kitamura, Shizuoka-ken (JP); Masanori Takai, Shizuoka-ken (JP); Kazuhiko Kikuchi, Kanagawa-ken (JP); Toyoyasu Kusaka, Shizuoka-ken (JP); Satoshi Kinouchi, Tokyo (JP); Yoshinori Tsueda, Shizuoka-ken (JP); Osamu Takagi, Tokyo (JP); Toshihiro Sone, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 160 days.

(21) Appl. No.: 11/943,157

(22) Filed: Nov. 20, 2007

(65) Prior Publication Data

US 2008/0118260 A1 May 22, 2008

Related U.S. Application Data

(60) Provisional application No. 60/866,959, filed on Nov. 22, 2006.

(51) Int. Cl.
*G03G 15/20* (2006.01)

(52) U.S. Cl. ..... 399/67

(58) Field of Classification Search ..... 399/38, 399/67, 69, 107, 122, 320, 328, 329, 330, 399/331; 219/219, 619
See application file for complete search history.

(56) References Cited

U.S. PATENT DOCUMENTS

| | | | | |
|---|---|---|---|---|
| 5,774,776 | A * | 6/1998 | Takada et al. | 399/328 |
| 7,081,604 | B2 * | 7/2006 | Sekiguchi | 219/619 |
| 7,184,697 | B2 * | 2/2007 | Kinouchi et al. | 399/328 |

FOREIGN PATENT DOCUMENTS

| | | |
|---|---|---|
| JP | 2006-010729 | 1/2006 |
| JP | 2006-337693 | 12/2006 |

* cited by examiner

*Primary Examiner*—Hoan H Tran
(74) *Attorney, Agent, or Firm*—Turocy & Watson, LLP

(57) ABSTRACT

An image formation apparatus is provided for supporting adjustment of the distance between a heat roller and a heating unit for heating the heat roller, thereby supporting adjustment of supplied power to the heating unit. The image formation apparatus includes a heat roller for clamping paper with a toner image formed thereon with a pressurization roller; a heating unit being placed facing the heat roller for heating the heat roller; a power supply unit for supplying power to the heating unit; an acquisition unit for acquiring a power value based on the power supplied from the power supply unit; a comparison unit for making a comparison between the power value acquired by the acquisition unit and a predetermined power value; and a display unit for displaying information concerning adjustment of a distance from the heat roller to the heating unit based on the comparison result of the comparison unit.

20 Claims, 5 Drawing Sheets

IMAGE FORMATION APPARATUS AND HEAT ROLLER ADJUSTMENT SUPPORT METHOD

BACKGROUND OF THE INVENTION

1. Field of the Invention

This invention relates to an image formation apparatus using induction heating and a heat roller adjustment support method.

2. Description of the Related Art

In an image formation apparatus using induction heating, a heat roller, etc., is a consumable and thus needs to be replaced.

However, if an old heat roller is replaced with a new one, an error occurs between the placement positions of the heat rollers before and after the replacement and therefore the distance (gap) from the new heat roller to an induction heating coil does not necessarily become constant. If a heat roller placement error thus occurs, a change also occurs in power output because the gap varies and desired power output cannot be obtained. If power which is not desired power is thus output, a problem may occur in a fixing state between a toner image and paper.

SUMMARY OF THE INVENTION

It is an object of the invention to provide an image formation apparatus of induction heating and a heat roller adjustment support method for calculating the power value of power supplied to a coil and supporting the user so as to optimize the gap between the coil and a heat roller based on the calculation result.

To solve the above-described problems, according to one aspect of the invention, there is provided an image formation apparatus including a heat roller containing an electric conductor, for clamping paper with a toner image formed thereon with a pressurization roller; a heating unit being placed facing the heat roller for heating the heat roller; a power supply unit for supplying power to the heating unit; an acquisition unit for acquiring a power value based on the power supplied from the power supply unit; a comparison unit for making a comparison between the power value acquired by the acquisition unit and a predetermined power value; and a display unit for displaying information concerning adjustment of a distance from the heat roller to the heating unit based on the comparison result of the comparison unit.

According to one aspect of the invention, there is provided an image formation apparatus including heating means being placed facing a heat roller containing an electric conductor, for clamping paper with a toner image formed thereon with a pressurization roller, the heating means for heating the heat roller; power supply means for supplying power to the heating means; acquisition means for acquiring a power value based on the power supplied from the power supply means; comparison means for making a comparison between the power value acquired by the acquisition means and a predetermined power value; and display means for displaying information concerning adjustment of a distance from the heat roller to the heating means based on the comparison result of the comparison means.

According to one aspect of the invention, there is provided a heat roller adjustment support method of supplying power to a heating unit being placed facing a heat roller containing an electric conductor, for clamping paper with a toner image formed thereon with a pressurization roller, the heating unit for heating the heat roller; acquiring a power value based on the supplied power; making a comparison between the acquired power value and a predetermined power value; and displaying information concerning adjustment of a distance from the heat roller to the heating unit based on the comparison result.

DESCRIPTION OF THE PREFERRED EMBODIMENTS

Referring now to the accompanying drawings, there is shown an embodiment of the invention.

Figure 1:
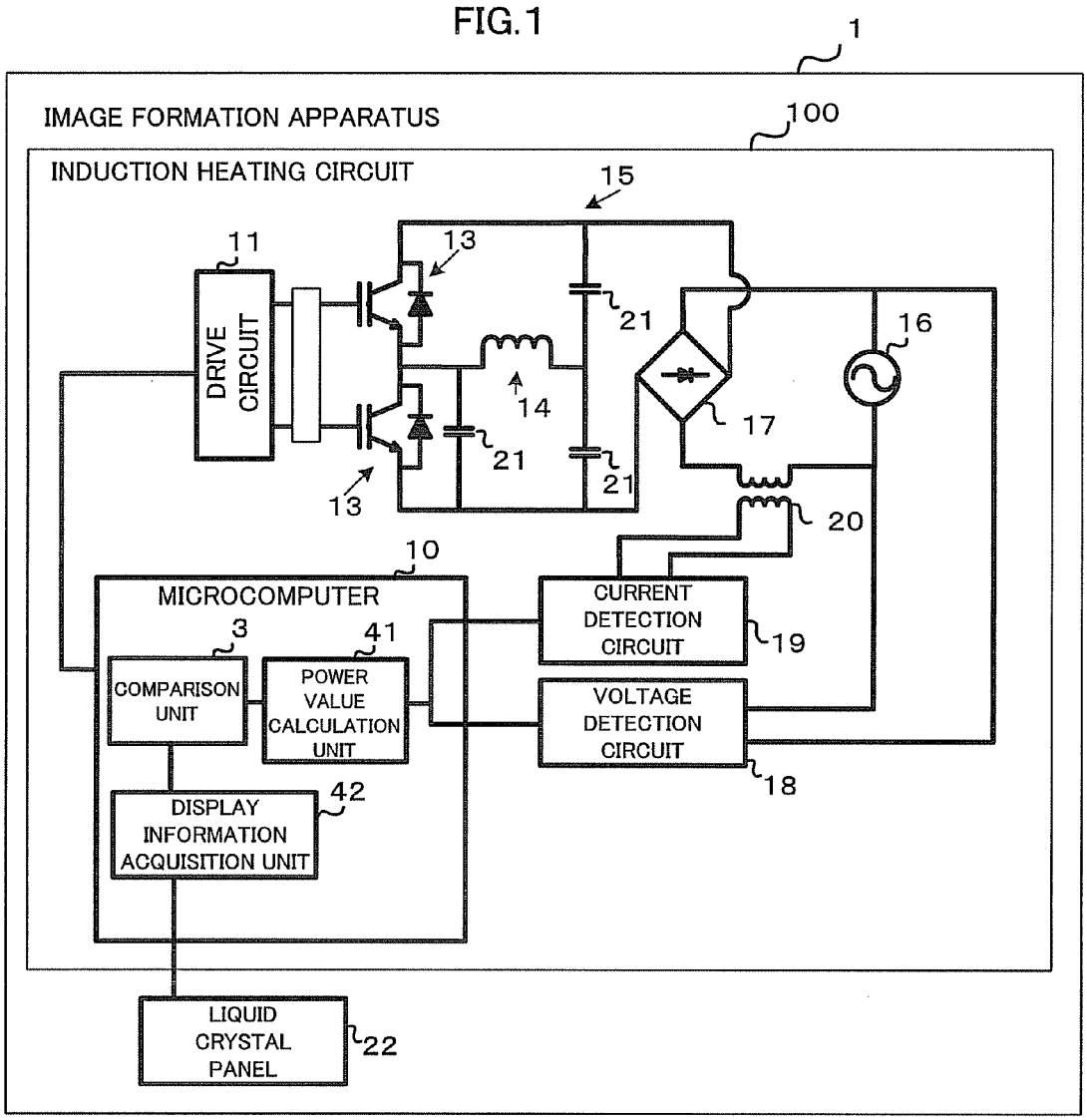
FIG. 1 is a diagram to show an example of an induction heating circuit included in an image formation apparatus according to an embodiment of the invention.

FIG. 1 is a diagram to describe an induction heating circuit in an image formation apparatus according to the embodiment of the invention.

An induction heating circuit 100 includes a microcomputer 10 for controlling the whole of an image formation apparatus 1 and a drive circuit 11 for controlling so as to drive at a drive frequency corresponding to output power. The induction heating circuit 100 also includes a resonance circuit 15, which includes an IGBT (Insulated Gate Bipolar Transistor) element 13 and a coil 14 (heating unit, heating means) and a capacitor 21 joined to the IGBT element 13. Power is supplied to the resonance circuit 15 via an AC power supply 16 (power supply unit, power supply means) and a rectifying circuit 17 and thus power is also supplied to the coil 14.

The induction heating circuit 100 also includes a voltage detection circuit 18 for detecting voltage of the AC power supply 16 and a current detection circuit 19 for detecting a current through a current transformer 20. The data detected by the detection circuits is fed back into the microcomputer 10.

The microcomputer 10 includes the functions of a power value calculation unit 41, a comparison unit 3 (comparison means), and a display information acquisition unit 42 in cooperation with firmware (not shown). The power value calculation unit 41 calculates a power value from the voltage detected by the voltage detection circuit 18 and the current detected by the current detection circuit 19. The comparison unit 3 makes a comparison between the power value calculated by the power value calculation unit 41 and a previously defined power value (predetermined power value).

The display information acquisition unit 42 acquires information concerning adjustment of the distance (gap) from a heat roller 30 (described later) to the coil 14 based on the comparison result of the comparison unit 3.

The display information acquisition unit 42 may acquire the information concerning adjustment of the gap by calculating the information using the power value calculated by the power value calculation unit 41 and a predetermined computation expression in the firmware or may acquire the information concerning adjustment of the gap based on a table previously defining the correspondence between the information concerning adjustment of the gap and the power value calculated by the power value calculation unit 41.

A liquid crystal panel 22 connected to the microcomputer 10 displays the information acquired by the display information acquisition unit 42 for the user.

Figure 2:
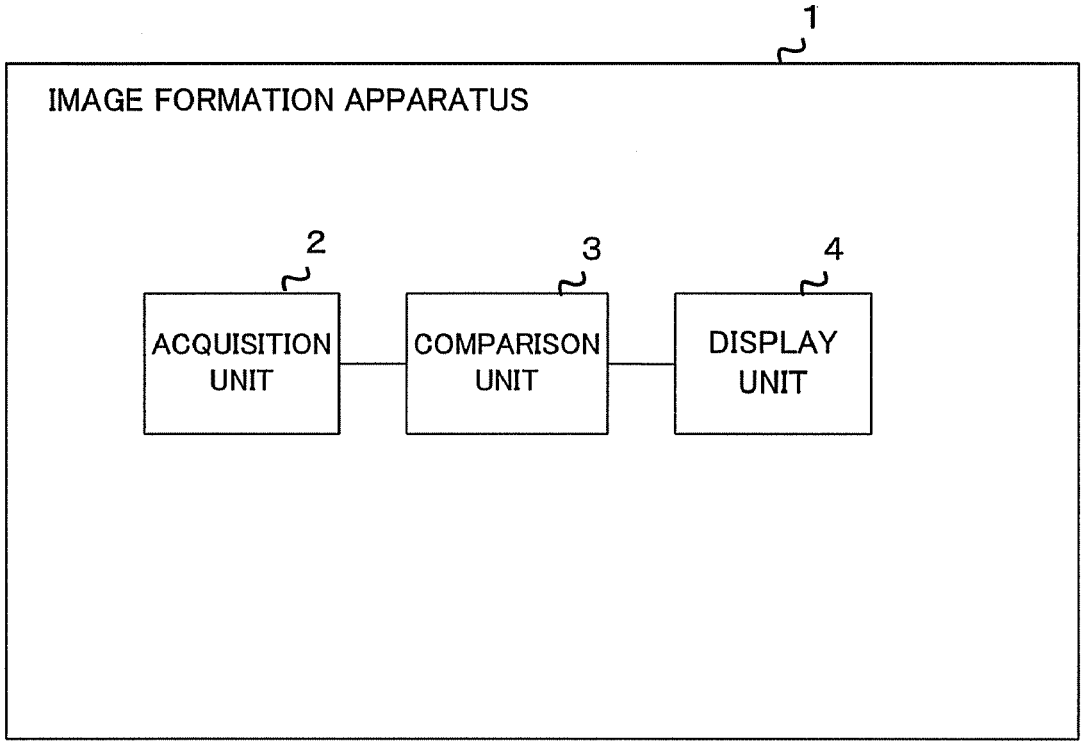
FIG. 2 is a block diagram to show an example of the functions implemented by a microcomputer, a voltage detection circuit, a current detection circuit, and a liquid crystal panel of the image formation apparatus according to the embodiment of the invention.

Next, the functions implemented by the microcomputer 10, the voltage detection circuit 18, the current detection circuit 19, and the liquid crystal panel 22 will be discussed with reference to FIG. 2.

The image formation apparatus 1 includes an acquisition unit 2 (acquisition means), the comparison unit 3, and a display unit 4 (display means). The acquisition unit 2 acquires the power value based on the power supplied from the AC power supply 16. The comparison unit 3 makes a comparison between the power value acquired by the acquisition unit 2 and the previously defined power value, as described above. The display unit 4 displays the information concerning adjustment of the gap based on the comparison result of the comparison unit 3.

The acquisition unit 2 corresponds to the voltage detection circuit 18, the current detected by the current detection circuit 19, and the power value calculation unit 41, and the display unit 4 corresponds to the display information acquisition unit 42 and the liquid crystal panel 22.

Figure 3:
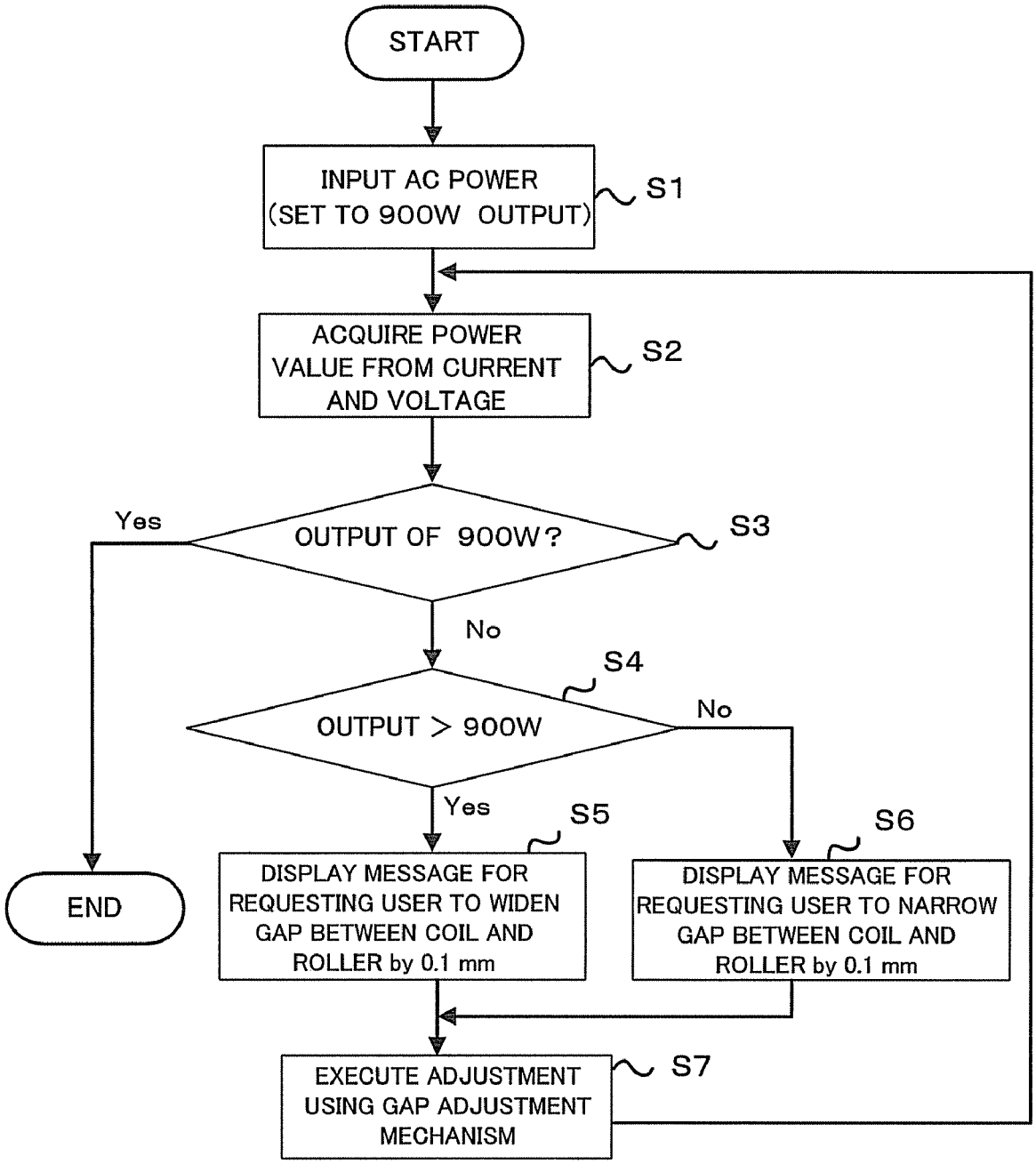
FIG. 3 is a flowchart to show an example of processing of adjustment support of a heat roller according to the embodiment of the invention.

Processing of adjustment support of the heat roller will be discussed with reference to a flowchart of FIG. 3. In the image formation apparatus 1 in the embodiment, for example, if the previously defined power value is 900 W and the microcomputer 10 gives a command for outputting 900 W, the drive circuit 11 drives at drive frequency 50 kHz.

After power is input in the AC power supply 16 (step S1), the acquisition unit 2 acquires the power value by acquiring the current and the voltage (power) of the coil 14 (step S2). The comparison unit 3 determines whether or not the power value acquired by the acquisition unit 2 is the previously defined power value, 900 W (step S3).

If the output value is 900 W (YES at step S3), the image formation apparatus 1 terminates the processing of heat roller adjustment support. On the other hand, if the output value is not 900 W (NO at step S3), then the comparison unit 3 makes a comparison between the power value acquired by the acquisition unit 2 and the previously defined power value, 900 W (step S4).

If the output value is larger than 900 W (YES at step S4), the display unit 4 displays a message for requesting the user to widen the gap by 0.1 mm as the information concerning adjustment of the gap on the liquid crystal panel 22 (step S5). On the other hand, if the output value is less than 900 W (NO at step S4), the display unit 5 displays a message for requesting the user to narrow the gap by 0.1 mm as the information concerning adjustment of the gap on the liquid crystal panel 22 (step S6).

The user checks the description displayed on the liquid crystal panel 22 and adjusts the gap between the coil 14 and the heat roller 30 with a gap adjustment mechanism 200 (described later) (step S7). After this, again the acquisition unit 2 acquires the power value (loop from step S7 to step S2). Thus, the power value acquisition, comparison, and display and the adjustment of the gap are repeated until the power value reaches the desired value 900 W.

The principle on which the power output changes with the gap change will be discussed. If the gap between the heat roller 30 (which contains an electric conductor) and the coil 14 is narrowed, the reactance (L) of the resonance circuit 15 increases; if the gap is widened, the reactance lessens. Since the resonance frequency is $f=(2\pi(LC)^{1/2})^{-1}$ (C: Electric capacitance of capacitor), as the reactance changes, the frequency changes. Therefore, the power output corresponding to the frequency changes.

Figure 4:
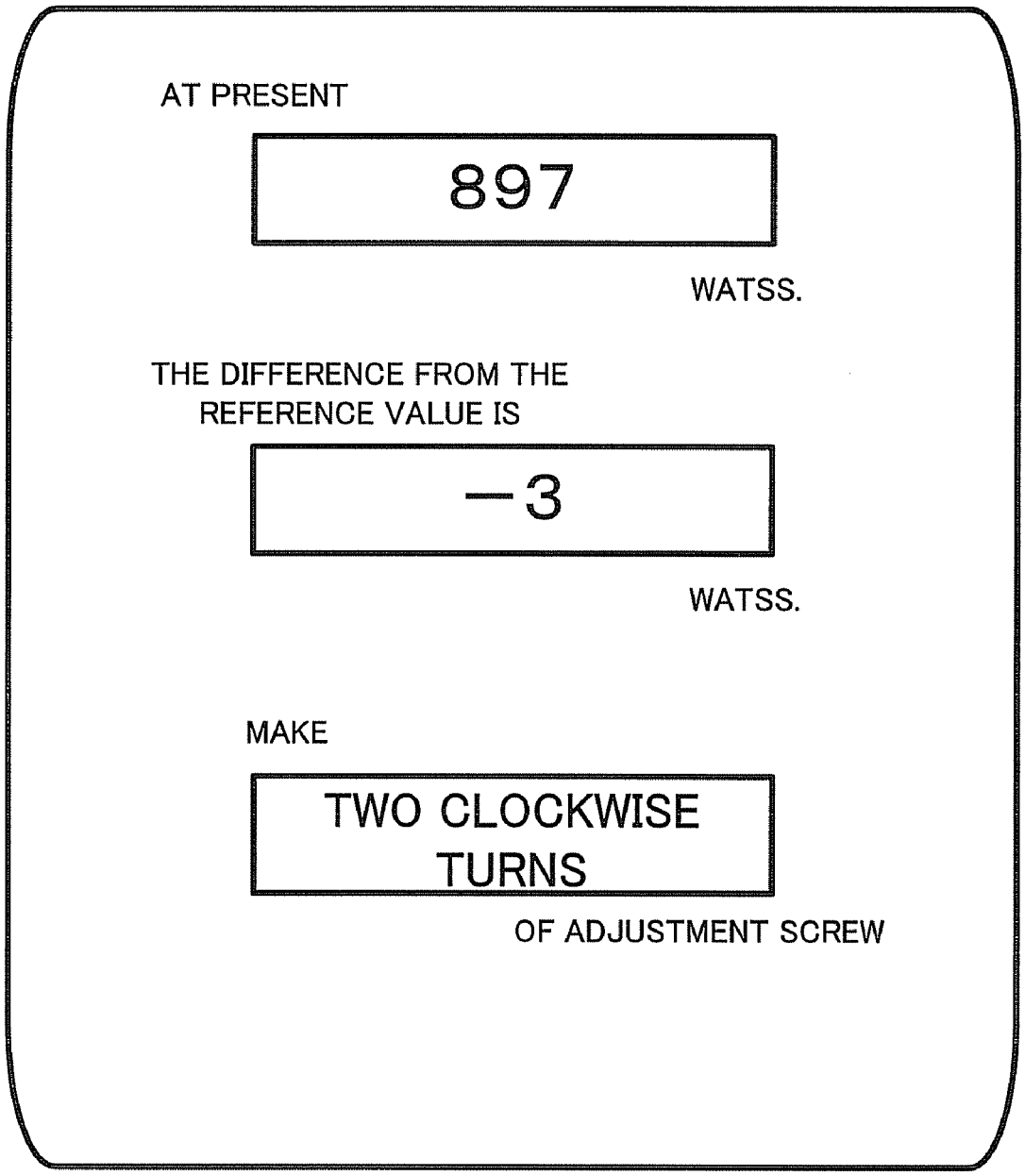
FIG. 4 is a drawing to show an example of display of a display section according to the embodiment of the invention.

FIG. 4 shows an example of the descriptions displayed on the liquid crystal panel 22 of the display unit 4. The display unit 4 displays the power value (output wattage) acquired by the acquisition unit 2 and displays the difference between the preset reference value (900 W) and the current output wattage. The display unit 4 also displays the turning direction of an adjustment screw 31 (described later) of the gap adjustment mechanism 200 and the number of turns of the screw as the information concerning adjustment of the gap based on the power value acquired by the acquisition unit 2. The display unit 4 may display the amount of widening (or narrowing) the gap as the information concerning adjustment of the gap, as shown above in the flowchart.

Figure 5:
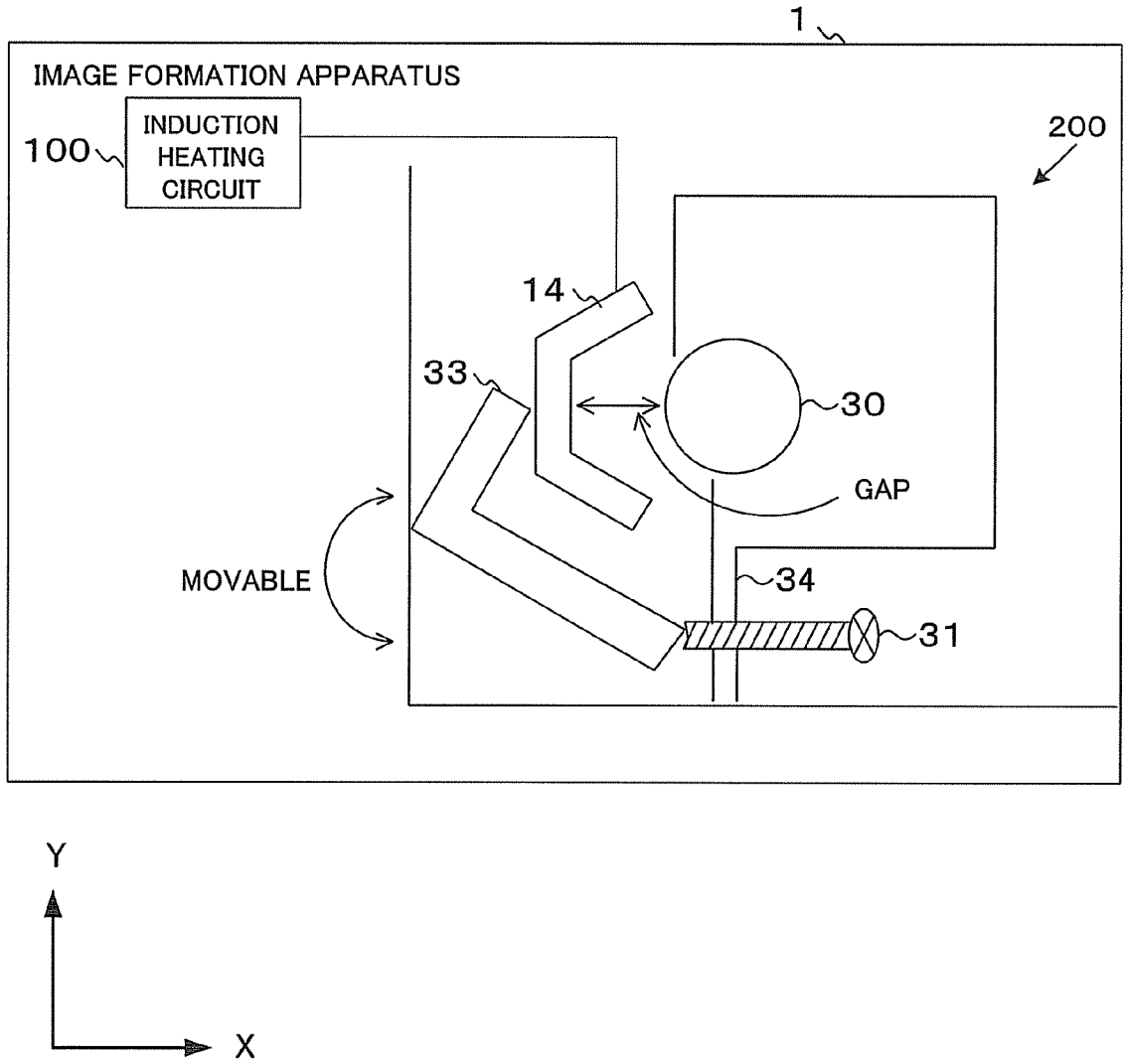
FIG. 5 is a drawing to show an example of a gap adjustment mechanism included in the image formation apparatus according to the embodiment of the invention.

Next, an example of the gap adjustment mechanism in the embodiment will be discussed with reference to FIG. 5. The gap adjustment mechanism 200 (adjustment unit, adjustment means) includes the adjustment screw 31 (varying means), a seesaw 33 (transmission unit, transmission means), and a side wall 34 (support unit, support means) for adjusting the gap between the heat roller 30 containing an electric conductor and the coil 14 placed facing the heat roller 30.

The adjustment screw 31 varies in an X axis direction as the user adds turning movement relative to an X axis (predetermined axis), for example. The adjustment screw 31 pierces the side wall 34 and is supported by the side wall 34.

The seesaw 33 has both end parts in contact with an end part of the adjustment screw 31 and the coil 14 and transmits a force so that the position of the coil 14 relative to the heat roller 30 varies based on variation of the position of the adjustment screw 31. The seesaw 33 is shaped like a letter L and has the right angle point as a supporting point. According to the structure, if the adjustment screw 31 moves in a negative direction relative to the X axis, the coil 14 moves in a positive direction through the seesaw 33; whereas, if the adjustment screw 31 moves in the positive direction relative to the X axis, the coil 14 moves in the negative direction through the seesaw 33.

The adjustment amount the gap between the heat roller 30 and the coil 14 is minute with respect to the move amount of the adjustment screw 31 by the user. Therefore, the seesaw 33 needs to have the supporting point (the right angle point in the shape of the letter L) at a position where the linear distance with the adjustment screw 31 is longer than the linear distance with the end part in contact with the coil 14.

The user turns the head of the adjustment screw 31 with a tool, etc., based on the description displayed on the liquid crystal panel 22 to adjust the position of the adjustment screw 31, thereby adjusting the gap between the heat roller 30 and the coil 14 so that the predetermined output power (in the embodiment, 900 W) is reached.

In the embodiment, the coil 14 is moved relative to the heat roller 30; in contrast, however, the heat roller 30 may be moved relative to the coil 14.

In the embodiment, the seesaw 33 is shaped like a letter L, but may be of any shape if the condition of the position of the supporting point is satisfied. If fine adjustment can be made with the adjustment screw, the gap adjustment mechanism 200 may adopt a structure in which the seesaw 33 is not used and the adjustment screw 31 and the coil 14 are directly joined.

In the embodiment, the information concerning adjustment of the gap, etc., is displayed using the liquid crystal panel 22, but the mode is not limited; for example, a voice guidance may be used.

In the embodiment, the output of the coil 14 is calculated based on detection of the current detection circuit 19 and the voltage detection circuit 18, but the embodiment is not limited to the mode. For example, the drive frequency of the coil 14 may be changed for making an adjustment so as to output 900 W. To change the drive frequency, if the output is lower than 900 W, setting is changed so as to decrease the drive frequency in 100-Hz units; if the output is larger than 900 W, setting is changed so as to increase the drive frequency in 100-Hz units. In this case, for the adjusted drive frequency, the value of a table retained in memory in the drive circuit 11 may be rewritten.

The frequency of the current flowing into the coil 14 may be measured by measuring the current flowing into the resonance circuit 15. In this case, for example, if the microcomputer gives a command to the drive circuit so as to drive at 50 kHz, it is necessary to detect whether or not the drive circuit actually drives at 50 kHz.

While the specific form of the invention has been described in detail, it is to be understood that various changes and modifications will be apparent to those skilled in the art without departing from the spirit and the scope of the invention.

As described above in detail, according to the invention, adjustment of the distance from the heat roller to the heating unit is supported, so that adjustment of supplied power to the heating unit can be supported.

What is claimed is:

1. An image formation apparatus comprising:

a heat roller containing an electric conductor, for clamping paper with a toner image formed thereon with a pressurization roller;

a heating unit being placed facing the heat roller for heating the heat roller;

a power supply unit for supplying power to the heating unit;

an acquisition unit for acquiring a power value based on the power supplied from the power supply unit;

a comparison unit for making a comparison between the power value acquired by the acquisition unit and a predetermined power value; and a display unit for displaying information concerning adjustment of a distance from the heat roller to the heating unit based on the comparison result of the comparison unit.

2. The image formation apparatus as claimed in claim 1 wherein the display unit further displays the power value acquired by the acquisition unit.

3. The image formation apparatus as claimed in claim 1 wherein the display unit further displays the difference between the power value acquired by the acquisition unit and the predetermined power value.

4. The image formation apparatus as claimed in claim 1 further comprising an adjustment unit capable of adjusting the distance from the heat roller to the heating unit.

5. The image formation apparatus as claimed in claim 4 wherein the adjustment unit comprises:

an adjustment screw being subjected to turning movement relative to a predetermined axis for varying in the direction of the predetermined axis;

a support unit for supporting the adjustment screw; and a transmission unit having both end parts in contact with an end part of the adjustment screw supported by the support unit and the heating unit for transmitting a force so that the position of the heating unit relative to the heat roller varies based on variation of the position of the adjustment screw.

6. The image formation apparatus as claimed in claim 5 wherein the display unit displays the number of turns of the adjustment screw relative to the predetermined axis as the information concerning the adjustment of the distance.

7. The image formation apparatus as claimed in claim 5 wherein the transmission unit has a supporting point at a position where the linear distance with the end part in contact with the adjustment screw is longer than the linear distance with the end part in contact with the heating unit.

8. An image formation apparatus comprising:

heating means being placed facing a heat roller containing an electric conductor, for clamping paper with a toner image formed thereon with a pressurization roller, the heating means for heating the heat roller;

power supply means for supplying power to the heating means;

acquisition means for acquiring a power value based on the power supplied from the power supply means;

comparison means for making a comparison between the power value acquired by the acquisition means and a predetermined power value; and display means for displaying information concerning adjustment of a distance from the heat roller to the heating means based on the comparison result of the comparison means.

9. The image formation apparatus as claimed in claim 8 wherein the display means further displays the power value acquired by the acquisition means.

10. The image formation apparatus as claimed in claim 8 wherein the display means further displays the difference between the power value acquired by the acquisition means and the predetermined power value.

11. The image formation apparatus as claimed in claim 8 further comprising adjustment means capable of adjusting the distance from the heat roller to the heating means.

12. The image formation apparatus as claimed in claim 11 wherein the adjustment means comprises:

varying means being subjected to turning movement relative to a predetermined axis for varying in the direction of the predetermined axis;

support means for supporting the varying means; and transmission means having both end parts in contact with an end part of the varying means supported by the support means and the heating means for transmitting a force so that the position of the heating means relative to the heat roller varies based on variation of the position of the varying means.

13. The image formation apparatus as claimed in claim 12 wherein the display means displays the number of turns of the varying means relative to the predetermined axis as information concerning adjustment of the distance.

14. The image formation apparatus as claimed in claim 12 wherein the transmission means has a supporting point at a position where the linear distance with the end part in contact with the varying means is longer than the linear distance with the end part in contact with the heating means.

15. A heat roller adjustment support method of supplying power to a heating unit being placed facing a heat roller containing an electric conductor, for clamping paper with a toner image formed thereon with a pressurization roller, the heating unit for heating the heat roller;

acquiring a power value based on the supplied power;

making a comparison between the acquired power value and a predetermined power value; and displaying information concerning adjustment of a distance from the heat roller to the heating unit based on the comparison result.

16. The heat roller adjustment support method as claimed in claim 15 wherein the acquired power value is further displayed.

17. The heat roller adjustment support method as claimed in claim 15 wherein the difference between the acquired power value and the predetermined power value is further displayed.

18. The heat roller adjustment support method as claimed in claim 15 wherein the distance from the heat roller to the heating unit can further be adjusted.

19. The heat roller adjustment support method as claimed in claim 18 wherein the distance from the heat roller to the heating unit is adjusted by using an adjustment unit comprising an adjustment screw being subjected to turning movement relative to a predetermined axis for varying in the direction of the predetermined axis, a support unit for supporting the adjustment screw, and a transmission unit having both end parts in contact with an end part of the adjustment screw supported by the support unit and the heating unit for transmitting a force so that the position of the heating unit relative to the heat roller varies based on variation of the position of the adjustment screw.

20. The heat roller adjustment support method as claimed in claim 19 wherein the information concerning the adjustment of the distance is the number of turns of the adjustment screw relative to the predetermined axis.

* * * * *